US006100781A

United States Patent [19]

Raets et al.

[11] Patent Number: 6,100,781

[45] Date of Patent: Aug. 8, 2000

[54] HIGH LEAKAGE INDUCTANCE TRANSFORMER

[75] Inventors: Hubert Raets, Landgraaf, Netherlands; Manfred Albach, Aachen, Germany

[73] Assignee: U.S. Philips Corporation, New York, N.Y.

[21] Appl. No.: 09/205,976

[22] Filed: Dec. 4, 1998

[30] Foreign Application Priority Data

Dec. 10, 1997 [DE] Germany ..... 197 54 845

[51] Int. Cl.[7] ..... H01F 27/28

[52] U.S. Cl. ..... 336/180; 336/181; 336/182

[58] Field of Search ..... 336/180, 181, 336/182

[56] References Cited

U.S. PATENT DOCUMENTS

| | | | |
|---|---|---|---|
| 3,445,928 | 5/1969 | Beynon | 336/180 |
| 4,166,264 | 8/1979 | Starr | 336/20 |
| 4,902,942 | 2/1990 | El-Hamamsy | 336/182 |

FOREIGN PATENT DOCUMENTS

| | | | |
|---|---|---|---|
| 2730342A1 | 8/1996 | France | H01F 27/28 |
| 362208611A | 9/1987 | Japan | 336/180 |
| 08181023A | 7/1996 | Japan | H01F 28/32 |
| 608-205 | 5/1978 | U.S.S.R. | 336/DIG. 1 |

*Primary Examiner*—Lincoln Donovan
*Assistant Examiner*—Anh Mai
*Attorney, Agent, or Firm*—Bernard Franzblau

[57] ABSTRACT

A transformer, particularly for a voltage converter, has a primary winding having a predeterminable leakage inductance and at least one secondary winding magnetically coupled to the primary winding with a predetermined voltage-transformation ratio. The (primary) leakage inductance is increased as compared with a conventional transformer without violating the limits for implementing an appropriately functioning transformer, and without choosing an additional coil or a larger core than is required for the power transformation, in that the primary winding comprises at least two winding sections whose magnetic couplings to the at least one secondary winding are implemented such that they operate in mutually opposite senses and are arranged such that they are at least substantially magnetically decoupled from one another.

16 Claims, 3 Drawing Sheets

HIGH LEAKAGE INDUCTANCE TRANSFORMER

BACKGROUND OF THE INVENTION

This invention relates to a transformer, particularly for a voltage converter, comprising a primary winding having a predeterminable leakage inductance and at least one secondary winding magnetically coupled to the primary winding in the predetermined voltage-transformation ratio.

In a transformer with a primary and a secondary winding and a core preferably formed from a magnetically conducting material, the value of the leakage inductances is determined by the number of turns of the individual windings and by the spatial arrangements of these windings. The leakage inductance increases with an increasing number of turns and with an increasing distance between the windings. The voltage transformation ratio, the magnetizing inductance and the losses occurring in the transformer, as well as the resultant increase of temperature, determine the number of turns for the primary and secondary winding in the dimensioning of the transformer. Due to these influences, limits are imposed on the dimensioning of a transformer, particularly as regards the maximum admissible number of turns. Moreover, the possibilities of varying the spatial arrangement of the windings are limited due to the core chosen for the relevant transformer. It has been found that the achievable values for the leakage inductances are thereby also limited. Particularly if such a transformer is used as a resonant element in a resonant-circuit power supply, it may occur that the value of the leakage inductance achievable with such a transformer cannot be dimensioned high enough. To achieve a sufficiently high leakage inductance, it will then be necessary to provide an additional coil or to choose a core for the transformer which is larger than would have to be dimensioned in accordance with the requirements for normal power transformation.

A transformer, particularly for a resonant power supply, is known from FR 2 730 342-A1, which comprises a primary winding and at least one secondary winding around a common core. The primary winding is divided into single flat coils which are provided on the core in a mutually offset way along the direction of the axis of the primary winding. To adapt the leakage inductance of the primary winding, the number of turns of the individual flat coils of the primary winding are different.

However, it has been found that the leakage inductance values cannot be increased to the desired extent by means of such an implementation of the primary winding. A transformer for an inverter (i.e. a switched-mode power supply) is known from JP-A 08-181023, particularly from its English-language abstract. In this transformer, the positions of the primary winding and the secondary winding are separated so as to vary the leakage inductance and the capacitance of the windings, by mean of which the power factor is improved and the energy losses are reduced.

Also in this arrangement, the values for the leakage inductance are limited and dimensioning cases occur for which the achievable values of the leakage inductances are not sufficient.

SUMMARY OF THE INVENTION

It is an object of the invention to implement a transformer of the type described in the opening paragraph in such a way that a larger value of the (primary) leakage inductance will be possible than is achievable with the means of the prior art, without violating the dimensioning limits for an appropriately functioning transformer and without providing an additional coil or a larger core.

The object and solution will hereinafter be elucidated for the implementation of the primary leakage inductance, without being limitative. The elucidations also apply to the implementation of a leakage inductance at the secondary side when the assignments of the windings to the primary and secondary side of the transformer are exchanged accordingly.

According to the invention, in a transformer of the type described in the opening paragraph, the object is achieved in that the primary winding comprises at least two winding sections whose magnetic couplings to at least one of the secondary windings are implemented in such a way that they operate in mutually opposite senses and are arranged in such a way that they are at least substantially magnetically decoupled with respect to each other.

For example, if the leakage inductance at the primary side is to be increased, the primary winding is split into at least two parts according to the invention, which parts generate a magnetic flux of opposite sign, i.e. directions, in the core of the transformer. This is effected in such a way that the magnetic fluxes generated by one part of the winding sections compensate the magnetic fluxes from the other parts of the primary winding to a predetermined extent. To this end, the sum of the numbers of turns of one part of the primary winding sections is increased by the desired number of primary winding turns which is larger than the sum of the numbers of turns of the other parts of the primary winding. Only the difference of the parts of the magnetic flux corresponding to the desired number of primary winding turns of the transformer and thus to the desired voltage transformation ratio is then coupled into the secondary winding(s). Nevertheless, a leakage inductance is effective for the primary side of the transformer, which inductance corresponds to the sum of all parts of the generated magnetic flux, thus also to those parts whose effect on the secondary winding(s) is eliminated. To this end, a substantial decoupling must be provided between the winding sections of the primary winding, but the individual winding sections themselves must be magnetically coupled to the secondary winding(s).

To achieve this, an advantageous implementation of the transformer according to the invention is characterized in that the winding sections of the primary winding and the secondary winding(s) are arranged on a common, magnetically conductive core, and in that the winding sections of the primary winding for forming decoupled leakage inductances are spatially separated from each other. Such a spatial separation is to be effected preferably also between the winding sections of the primary winding and the secondary winding.

To obtain the magnetic fluxes with opposite directions, a further embodiment of the transformer according to the invention is implemented in such a way that the winding sections of the primary winding have a winding direction which is oppositely oriented with respect to the direction of a primary current to be jointly supplied to said sections. Thus, either the individual winding sections of the primary winding are wound with a different winding sense, i.e. in the opposite sense, or the ends of every two winding sections of the primary winding with the same winding sense are connected in the opposite sense, i.e. such that the current flowing therethrough generates two oppositely directed magnetic fluxes.

In a further embodiment of the transformer according to the invention, the ratio between the number(s) of turns of the secondary winding(s) and the difference of the numbers of turns of the winding sections of the primary winding is fixed in accordance with the predetermined voltage transformation ratio(s).

A transformer of the type according to the invention is preferably usable for resonant voltage converters which particularly use the leakage inductance of the transformer at the primary side as a resonant element. Transformers according to the invention, particularly in such a voltage converter, can be advantageously used in electrical apparatuses of all kinds, particularly those which are powered from the AC supply voltage mains, but also from preferably electrochemical energy storage means or energy sources whose voltages are to be converted for use in electrical apparatuses.

These and other aspects of the invention will become apparent from and will be elucidated with reference to the embodiments described hereinafter. Corresponding elements in the Figures are denoted by the same reference symbols.

DESCRIPTION OF THE PREFERRED EMBODIMENTS

Figure 1:
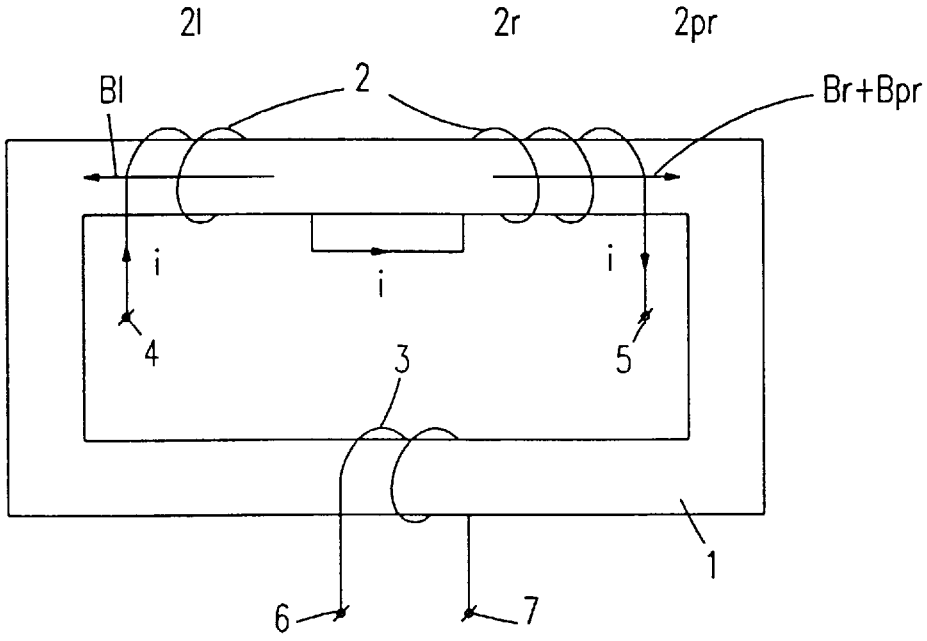
FIGS. 1, 2 and 3 show embodiments of a transformer according to the invention, with a different winding sense and a different division of the primary winding.

FIG. 1 shows very diagrammatically a transformer comprising a core 1 of a magnetically conducting material, a primary winding 2 and a secondary winding 3. The primary winding 2 comprises a first, left-wound primary winding section 2*l*, a second, right-wound primary winding section 2*r* and a third, right-wound primary winding section 2*pr* electrically arranged in series between two connection points 4 and 5. In the example of FIG. 1, the number of turns of the first primary winding section 2*l* and the second primary winding section 2*r* correspond to each other, while the second primary winding section 2*r* and the third primary winding section 2*pr* are through-wound. The reference i denotes a current flowing through the primary winding 2. The references Bl, Br and Bpr denote the magnetic inductances (fluxes) generated by the current i in the primary winding sections 2*l*, 2*r* and 2*pr* and flowing through the core 1. Due to the opposite winding sense of the first and the second primary winding section 2*l* and 2*r*, the effect of the magnetic fluxes Bl and Br on the secondary winding 3 is eliminated. For the transformer, i.e. its voltage transformation ratio, only the ratio of the number of turns of the third primary winding 2*pr* and the secondary winding 3 is effective from the primary side, i.e. the connection points 4 and 5, to the secondary side, i.e. the connection points 6 and 7 of the secondary winding 3.

Figure 2:
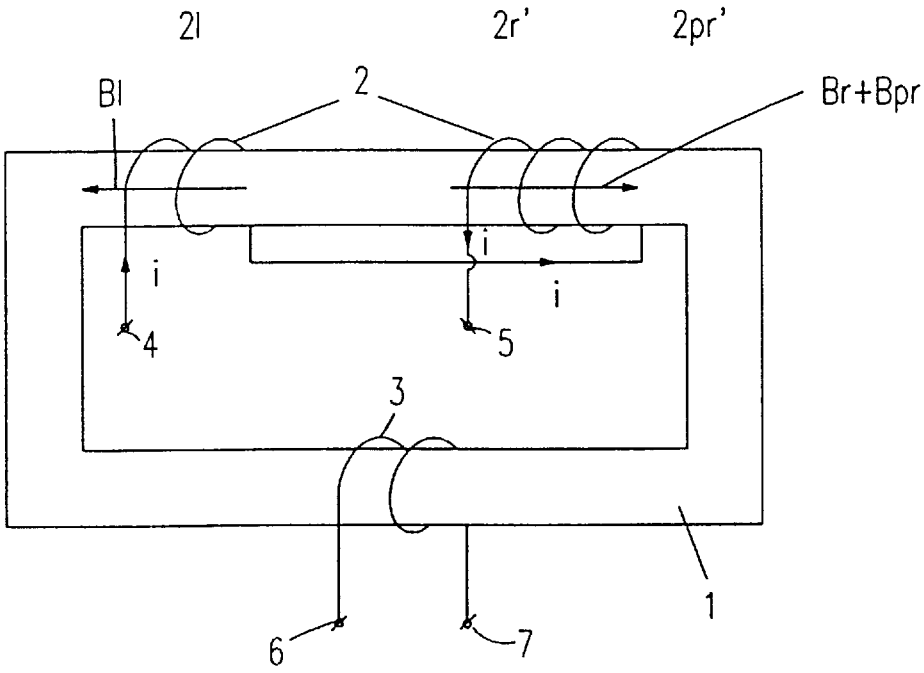

FIG. 2 shows a variant of the arrangement of FIG. 1, in which, in contrast to FIG. 1, all primary winding sections have the same winding sense, i.e. they are left-wound. The second and third, left-wound primary winding sections are denoted accordingly by the reference symbols 2*r*' and 2*pr*'. The numbers of turns correspond to those in FIG. 1. To generate oppositely directed magnetic fluxes, the second end of the first primary winding section 2*l* in FIG. 2 is connected to the second end of the third primary winding section 2*pr*', whereas the first end of the second primary winding section 2*r*' is connected to the connection point 5 of the primary winding 2. The magnetic fluxes and hence the voltage transformation ratio, as well as the leakage inductance of the transformer shown in FIG. 2, correspond to those of the transformer shown in FIG. 1.

Figure 3:
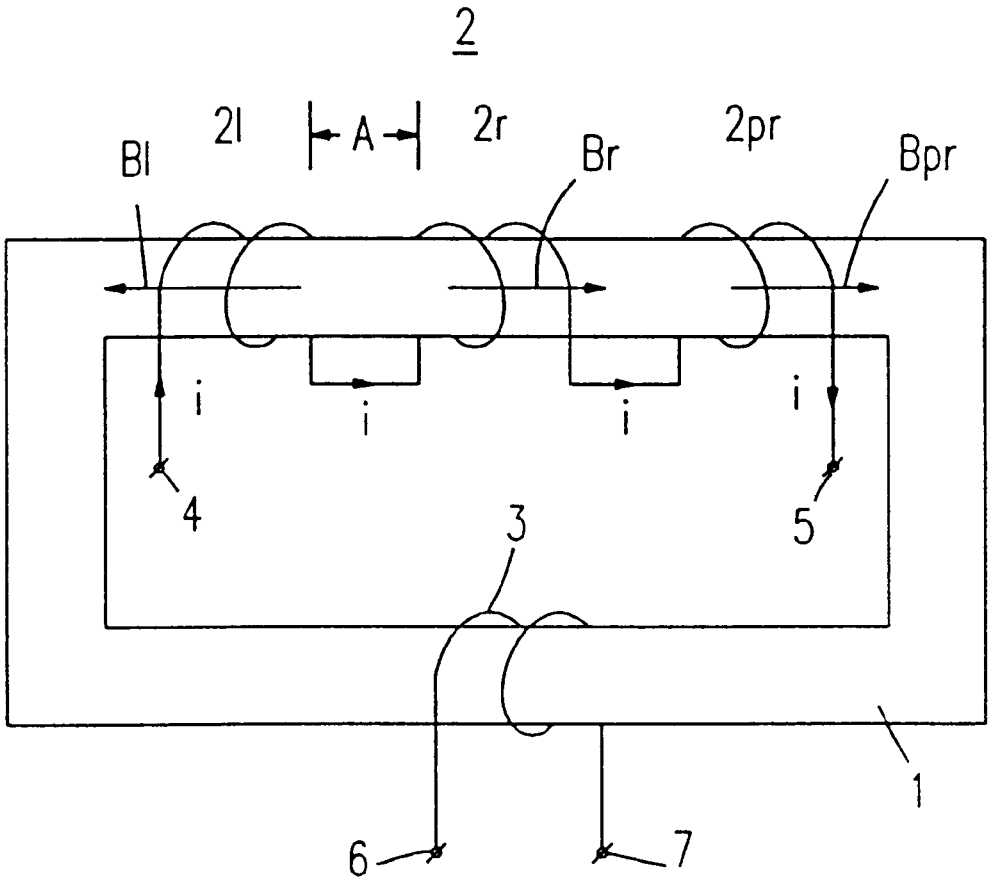

For further elucidation, FIG. 3 shows the transformer of FIG. 1 in greater detail. Particularly, the second and third primary winding sections 2*r* and 2*pr* are shown separately and consequently also the magnetic inductions Br and Bpr generated thereby. The first primary winding section 21 generates a magnetic flux B*l* directed towards the left in the upper part of the core 1 in FIG. 3, while the second primary winding section 2*r* generates an equally large magnetic flux Br which is, however, directed towards the right, as is determined by the different winding sense of these primary winding sections. The magnetic fluxes Bl and Br eliminate each other in the core 1 so that there is no resultant flux from these magnetic fluxes Bl and Br in the core 1, particularly in its lower part which is surrounded by the secondary winding 3. The first and second primary winding sections 2*l* and 2*r* rather produce a stray field and hence a leakage inductance. Only the third primary winding section 2*pr* magnetizes the core 1 in its lower part as well and is thus effective for the transfer of energy to the secondary winding 3 and the voltage transformation ratio. A symbolizes a spatial distance between the first primary winding section 2*l* and the second primary winding section 2*r*, which distance is to serve for decoupling these primary winding sections.

Figure 4:
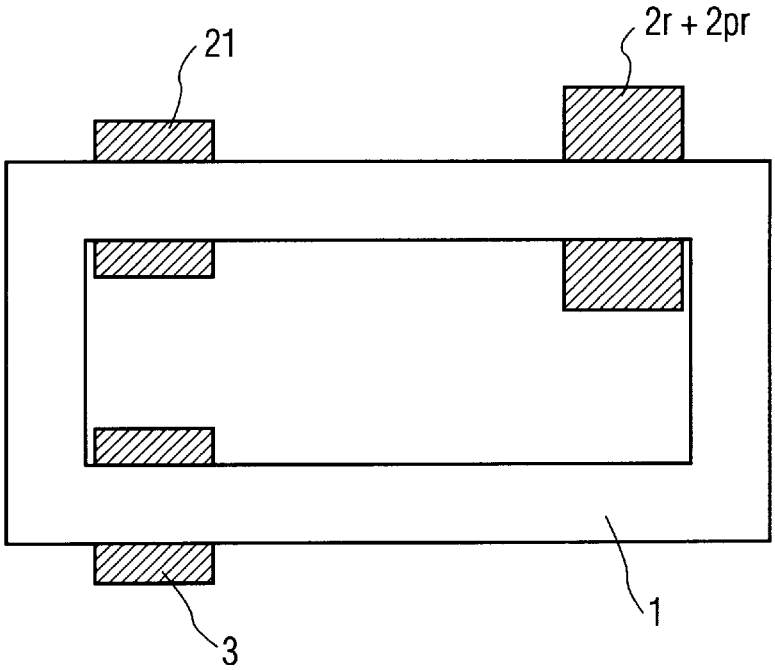
FIGS. 4 and 5 show examples of a spatial arrangement of primary and secondary windings of a transformer according to the invention.

In the transformer according to the invention, it is advantageous to choose a large distance between the first and the second primary winding section 2*l* and 2*r*, and it is also advantageous to choose a large distance between the third primary winding section 2*pr* and the secondary winding 3. Examples of an arrangement of these windings on a U core 1 are diagrammatically shown in FIGS. 4 and 5. In FIG. 4, the first primary winding section 2*l* is arranged on the core 1 at the upper left, and the combination of the second and third primary winding sections 2*r*+2*pr* is arranged in the core 1 at the upper right. The secondary winding 3 is arranged on the core 1 at the bottom left.

Figure 5:
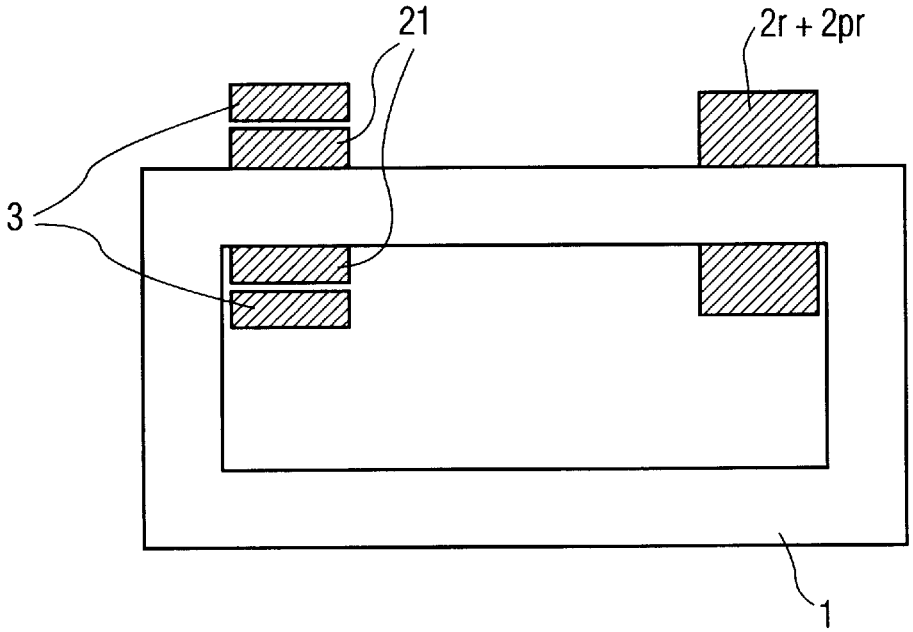

In the variant shown in FIG. 5, the arrangement consisting of the second and the third primary winding section 2*r*+2*pr* and the arrangement of the first primary winding section 2*l* are unchanged with respect to FIG. 4. As a variant, the secondary winding 3 is arranged on the first primary winding section 2*l*. Also this form fulfills the above-described spacing rules to be preferably maintained, but the lower part of the core 1 in FIG. 5 remains free from windings.

In a further variant of the invention, the transformer may comprise a plurality of secondary windings. In so far as an increased leakage inductance is desired for a secondary winding, the measures according to the invention may not only be implemented for the primary winding but also for this secondary winding. The leakage inductances of the transformer according to the invention can thus be dimensioned within wide limits without an additional coil or a larger core being required for the power transformation. The transformer according to the invention can thus be implemented in a compact form and at low cost.

What is claimed is:

1. A transformer, particularly for a voltage converter, comprising a primary winding and at least one secondary winding magnetically coupled to the primary winding with a predetermined voltage-transformation ratio, characterized in that the primary winding comprises at least two winding sections whose magnetic couplings to at least one of the secondary windings are arranged such that they operate in mutually opposite senses and are arranged in such a way that they are at least substantially magnetically decoupled with respect to each other whereby the primary winding exhibits a predeterminable leakage inductance.

2. A transformer as claimed in claim 1, wherein the winding sections of the primary winding and the secondary winding(s) are arranged on a common, magnetically conductive core, and in that the winding sections of the primary winding are spatially separated from each other to provide decoupled leakage inductances.

3. A transformer as claimed in claim 2, wherein the winding sections of the primary winding have a winding direction which is oppositely oriented with respect to the direction of a primary current to be jointly supplied to said winding sections.

4. A transformer as claimed in claim 3, wherein the ratio between the number(s) of turns of the secondary winding(s) and the difference of the numbers of turns of the winding sections of the primary winding is fixed in accordance with the predetermined voltage transformation ratio(s).

5. An electrical apparatus, comprising a transformer as claimed in claim 2.

6. A voltage converter, comprising a transformer as claimed in claim 1 wherein said primary winding leakage inductance is a resonant element of a resonant circuit of the voltage converter.

7. The transformer as claimed in claim 1 wherein one winding section has more turns than the other winding section in accordance with said predetermined voltage transformation ratio.

8. A transformer comprising:

a magnetic core, a primary winding on said magnetic core and comprising first and second electrically coupled winding sections, at least one secondary winding on said magnetic core arranged so that said one secondary winding is magnetically coupled to the primary winding with a particular voltage transformation ratio, and wherein the magnetic coupling of the first and second winding sections of the primary winding to the at least one secondary winding produces magnetic fluxes in the magnetic core in mutually opposite senses with respect to the at least one secondary winding, and said first and second primary winding sections are arranged so that they are at least substantially magnetically decoupled from one another so as to produce a predetermined leakage inductance of the transformer primary winding.

9. The transformer as claimed in claim 8 wherein said first and second winding sections are wound on said magnetic core in opposite senses so as to produce said magnetic fluxes in mutually opposite senses.

10. The transformer as claimed in claim 8 wherein said first and second winding sections are wound on said magnetic core so that a primary current flowing serially therethrough produces in said magnetic core first and second magnetic fluxes in mutually opposite senses.

11. The transformer as claimed in claim 10 wherein said first magnetic flux is greater than said second magnetic flux.

12. The transformer as claimed in claim 8 wherein the first winding section has more turns than the second winding section in accordance with said particular voltage transformation ratio.

13. The transformer as claimed in claim 12 wherein said first and second winding sections are wound on said magnetic core and spaced apart from one another so as to produce said magnetic decoupling and thereby a transformer with a very high leakage inductance.

14. The transformer as claimed in claim 8 wherein said first and second winding sections produce first and second equal and opposite magnetic fluxes in said magnetic core, and wherein the primary winding has a third winding section on said magnetic core and electrically coupled in series with the first and second winding sections, said third winding section, together with the secondary winding, determining the value of the transformer voltage transformation ratio.

15. The transformer as claimed in claim 14 wherein said first and second winding sections are wound on said magnetic core in opposite senses.

16. The transformer as claimed in claim 8 wherein the primary winding has terminals for coupling electric energy from a source of electric energy to the primary winding and the one secondary winding has terminals for coupling electric energy derived from the primary winding to an electric load to be supplied via the transformer.

* * * * *